United States Patent [19]

Bullard

[11] Patent Number: 4,973,171

[45] Date of Patent: Nov. 27, 1990

[54] CLOSABLE PLASTIC BAG

[75] Inventor: Edward M. Bullard, East Rochester, N.Y.

[73] Assignee: Mobil Oil Corporation, New York, N.Y.

[21] Appl. No.: 375,554

[22] Filed: Jul. 5, 1989

[51] Int. Cl.[5] ..... B65D 33/30

[52] U.S. Cl. ..... 383/70; 383/71; 383/88; 383/95; 383/905

[58] Field of Search ..... 383/70, 71, 88, 89, 383/95, 905; 229/87.08, 87.09, 87.2

[56] References Cited

U.S. PATENT DOCUMENTS

| | | | |
|---|---|---|---|
| 2,009,511 | 7/1935 | Nydegger | 383/70 X |
| 3,150,813 | 9/1964 | Wellman | 383/89 |
| 3,330,469 | 7/1967 | Koncak | 383/70 X |
| 3,353,662 | 11/1967 | Pickin | 383/71 X |
| 3,618,850 | 11/1971 | Palmer | 383/905 X |
| 4,117,934 | 10/1978 | Mowli et al. | 383/905 X |
| 4,558,463 | 12/1985 | Boyd | 383/75 |
| 4,797,313 | 1/1989 | Stolk et al. | 24/30.5 P X |
| 4,801,014 | 1/1989 | Meadows | 383/905 X |
| 4,842,187 | 6/1989 | Janocha et al. | 229/87 F X |

FOREIGN PATENT DOCUMENTS

| | | | |
|---|---|---|---|
| 1011649 | 12/1965 | United Kingdom | 383/905 |
| 2036683 | 7/1980 | United Kingdom | 383/905 |

*Primary Examiner*—Stephen P. Garbe
*Assistant Examiner*—Jes F. Pascua
*Attorney, Agent, or Firm*—Alexander J. McKillop; Charles J. Speciale; James P. O'Sullivan, Sr.

[57] ABSTRACT

A plastic bag, such as a trash bag or the like, of linear low density polyethylene or a blend of low density polyethylene and low density polyethylene has a closure portion along its open end. The closure portion is of a plastic having dead fold properties, such as oriented high density polyethylene or polystyrene. The bag can be closed by twisting the closure portion. The dead fold property of the closure portion will maintain the twisted condition of the closure portion to maintain the bag closed.

1 Claim, 1 Drawing Sheet

CLOSABLE PLASTIC BAG

FIELD OF THE INVENTION

The present invention relates to a closable plastic bag, and more particularly, to a plastic bag which can be closed by twisting the top of the bag.

BACKGROUND OF THE INVENTION

Plastic bags, such as plastic trash bags, are generally closed by means of a twist tie that is placed around the top of the bag after the bag is twisted to close it. Generally, the ties are provided in strips in the box in which the bags are sold. This type of tie is often hard to find after they have been removed from the box and, if the bag is full, the ties do not always hold the bag closed. Plastic key locks ties in which one end of the plastic tie strip is inserted through a key lock in the other end of the tie, are also used to achieve a closing of the bag. However, this type of tie is more expensive than the plain twist tie, and still are subject to being lost after they have been removed from the box. In an attempt to prevent the ties from being lost, a separate tie has been taped to each bag. However, this not only increases the cost of the bag, but also the ties are sometimes accidentally pulled off the bag when the bag is removed from the box or other package in which the bag is sold. Another type of closing means for plastic trash bags is a draw tape or the like extending through a hem at the top of the bag which will draw the top of the bag closed. One such bag of this type is disclosed in U.S. Pat. No. 4,558,463 to D. M. Boyd, issued Dec. 10, 1985, entitled HEM SEAL FOR DRAW TAPE TRASH BAG. Although this provides a good closure for the bag, it adds considerably to the cost of the bag. Therefore, it would be desirable to have a plastic trash bag which can be easily closed without any additional tie elements.

SUMMARY OF THE INVENTION

A plastic bag includes a tubular bottom portion of plastic having a closed end and an open end, and a closure portion along the open end. The closure portion of a plastic material having dead fold characteristics so that when the closure portion is twisted, it will remain in twisted condition to close the bag.

DETAILED DESCRIPTION OF THE PREFERRED EMBODIMENT

Figure 1:
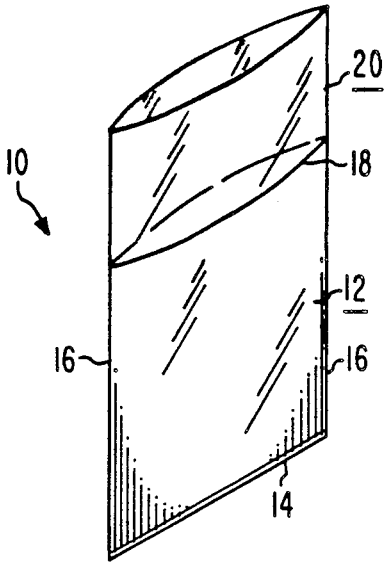
FIG. 1 is a perspective of a plastic bag which incorporates the closure of the present invention.

Referring to FIG. 1, a trash bag or similar bag which incorporates the closure of the present invention is generally designated as 10. The bag 10 includes a tubular main portion 12 having a closed bottom end 14, closed sides 16 and an open top end 18. The main portion 12 of the bag 10 is preferably made of linear low density polyethylene (LLDPE) plastic. LLDPE is a copolymer of ethylene and a $C_3$–$C_{10}$ alpha olefin (presently $C_4$–$C_8$ is preferably used). The alpha olefin is in a minor proportion, about 3–8%. The density is about 0.918 to 0.93 gm/cc. depending on the copolymer. The main portion 12 of the bag 10 may also be made of blends of LLDPE and up to 20% of LDPE (low density polyethylene, which is 0.5 to 2.0 MI and has a density of about 0.918 to 0.930 gm/cc). The main portion 12 may be made from a sheet of extruded LLDPE which is folded to form two overlapping sides with the fold line forming the bottom end of the bags. The two overlapping sides of the plastic sheet are sealed together along spaced, parallel seams extending the fold line to the free edges of the sheet. The seams will form the side edges 16 of the bags 10. The strip is cut along the seam lines to separate the bags 10. This process is described in the U.S. Pat. No. 4,558,463 to Boyd, which is incorporated herein by reference.

Along the open top end 18 of the main portion 12 is a closure portion 20. The closure portion 20 is a wide strip, having a length from the top end 18 of the main portion 12 of at least about 2 inches, of a plastic having dead fold properties. By dead fold properties, it is meant that when the closure portion is twisted or crumpled together, it will retain the twisted or crumpled condition. A plastic having suitable dead fold properties for the closure portion 20 is oriented high density polyethylene or polystyrene. The closure portion 20 may be secured to the open end 18 of the main portion 12 with a suitable adhesive tape or by coextruding the plastic of the closure portion 20 with the LLDPE to form a strip having the dead fold property along the edges of the sheet of the LLDPE so that when the sheet is folded, the dead fold material will be along the open end of the bags.

EXAMPLE

A plastic bag made of LLDPE blended with 10% LDPE had a strip of 1.51 mil biaxial oriented high density polyethylene secured around its top edge by means of an adhesive tape. The top of the bag was twisted together with the adjacent portion of the LLDPE bag. The dead fold property of the top portion held the twist together keeping the sealed top closed.

Figure 2:
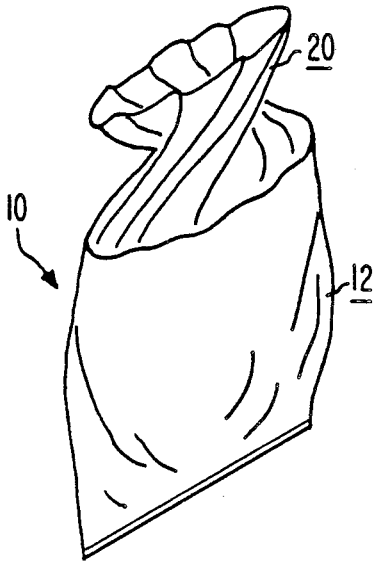
FIG. 2 is a perspective view showing the bag twisted to close it.

As shown in FIG. 2, when the bag 10 is filled, the closure portion 20 is twisted. Since the closure portion 20 is made of a dead fold material, it will retain its twisted condition so as to seal the bag in a closed condition. Thus, there is provided by the present invention a plastic bag which can be easily and quickly closed by merely twisting the top closure portion of the bag, and the bag will remain closed without the need of any special ties or pull tapes. This not only provides a bag which can be easily closed, but also provides a bag which is less expensive since it does not require any closure ties or pull tapes.

What is claimed is:

1. A plastic bag comprising:

a tubular main portion of linear low density polyethylene having a closed end and an open end; and a closure portion along the open end of the main portion, said closure portion being a dead fold plastic selected from the group consisting of oriented high density polyethylene and polystyrene, in which the closure portion is a portion coextruded with the plastic of the main portion.

* * * * *